US008327860B2

(12) United States Patent
Flowers

(10) Patent No.: US 8,327,860 B2
(45) Date of Patent: Dec. 11, 2012

(54) HEAT RETAINING HAIR CURLING SYSTEM AND METHOD OF STYLING

(75) Inventor: Linda Flowers, Los Angeles, CA (US)

(73) Assignee: Linda Flowers, Los Angeles, CA (US)

( * ) Notice: Subject to any disclaimer, the term of this patent is extended or adjusted under 35 U.S.C. 154(b) by 431 days.

(21) Appl. No.: 12/056,669

(22) Filed: Mar. 27, 2008

(65) Prior Publication Data

US 2008/0236606 A1 Oct. 2, 2008

Related U.S. Application Data

(60) Provisional application No. 60/907,265, filed on Mar. 27, 2007.

(51) Int. Cl.
*A45D 4/16* (2006.01)

(52) U.S. Cl. ..... 132/233

(58) Field of Classification Search ..... 132/273, 132/276, 277, 220, 233, 234, 236; 219/225, 219/226

See application file for complete search history.

(56) References Cited

U.S. PATENT DOCUMENTS

| | | | | | |
|---|---|---|---|---|---|
| 1,972,186 | A | | 9/1934 | Davis | |
| 2,161,202 | A | | 6/1939 | Schleimer | |
| 2,491,939 | A | * | 12/1949 | Tasho | 219/242 |
| 2,517,253 | A | | 8/1950 | Spaeth | |
| 3,380,720 | A | | 4/1968 | Bauer | |
| 3,889,097 | A | * | 6/1975 | Forsberg | 219/242 |
| 3,946,196 | A | | 3/1976 | Waters et al. | |
| 4,254,324 | A | | 3/1981 | Vrtaric | |
| 5,294,777 | A | | 3/1994 | Denhup | |
| 5,522,407 | A | * | 6/1996 | Kelsey | 132/231 |
| 5,873,377 | A | * | 2/1999 | Yang | 132/277 |
| D552,793 | S | | 10/2007 | Pichon | |
| 7,631,649 | B2 | * | 12/2009 | Coral et al. | 132/277 |
| 2005/0056297 | A1 | | 3/2005 | Maione | |
| 2005/0087205 | A1 | * | 4/2005 | Rizzuto, Jr. | 132/228 |
| 2007/0209763 | A1 | | 9/2007 | Chen | |
| 2008/0236606 | A1 | | 10/2008 | Flowers | |

OTHER PUBLICATIONS

Remington H-2050 Hair Setter http://www.remingtonhaircare.com/style/h2050b.shtml.
Thermo Clip http://www.theclipncoolhairstylingtool.com/.
Printout from www.remingtonproducts.com.
International Search Report dated Apr. 5, 2012.

* cited by examiner

*Primary Examiner* — Rachel Steitz
(74) *Attorney, Agent, or Firm* — Laura M. Lloyd; Jeffrey G. Sheldon; Sheldon Mak & Anderson

(57) ABSTRACT

An improved hair styling device with heating elements and heat retaining clips inside the device's housing. The clips present double concave inner faces, and form an enclosed space when in a closed position. A heat retaining element with an elevated heat capacity is incorporated into the clips adjacent the inner surface of the jaws of the clips; and also presents a double concave surface to the inside of the clips when in a closed position. The heating elements are made up of elongated heating rods with multiple heating locations along their length. Each heating location has an enlarged double convex area on the surface of the heating rods. The heating locations are complimentary to the shape of the heat retaining element, and therefore heat the clips quickly and evenly.

18 Claims, 5 Drawing Sheets

HEAT RETAINING HAIR CURLING SYSTEM AND METHOD OF STYLING

CROSS-REFERENCE TO RELATED APPLICATION

This application claims the benefit of the priority date of provisional application No. 60/907,265, filed on Mar. 27, 2007.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Heated curling products and heated curling clips are known in the art.

U.S. Pat. No. 5,522,407 to Kelsey discloses a heated hair clip with heatable plates mounted for universal movement to be used in connection with U-shaped hair curlers.

U.S. Pat. No. 5,294,777 to Denhup discloses a hair clip with plates for storing and releasing heat, and lateral supports for styling hair perpendicular to the scalp.

The heated curling clips of the current state of the art adjoin strands of hair, and apply direct pressure. These methods result in damaged hair follicles due to the heat and pressure exerted on hair follicles. Additionally, they result in a specific type of hair style unlike that of the instant invention.

Due to the limitations of these devices there is a need for a clip-type hair styling device wherein the clips have heat storage characteristics that avoid hair damage, and which can be used to create styles of hair comprising, in particular, loose waves and curls.

It is therefore an object of the present invention to provide a device employing clips for styling hair, comprising a heating means and a series of heatable clips. It is a further object of the invention to provide a clip-type that does not cause damage to the hair by overly constraining or heating it. Another object of the invention is to provide a heat retaining means incorporated into the clips.

Finally, it is an object of the present invention to provide a heated hair clip device wherein the clips provide a heated space containing loosely constrained hair, thereby imparting a temporary shape to the hair when removed from a clip.

SUMMARY

An improved hair curling device comprises a housing containing heating elements and a series of heat retaining clipping means. The clipping means comprises a pair of hinged opposing jaws biased to a closed position. The jaws present facing concave inside surfaces to each other in a manner that creates a confined space between the jaws with the clipping means in a closed position.

The clipping means further comprises a heat retaining means attached to the inside surfaces of the clipping means. The heat retaining means is disposed on the inside of the clipping means, and has an elevated heat capacity.

The heating elements of the device comprise members with a series of convex surface areas disposed along their length. The convex areas are complimentary to the concave inner surfaces of the clipping means and heat retaining means in such a manner that when a clipping means is disposed on a heating element, the heat retaining means is in complete contact with the convex surface, thereby heating the heat retaining means quickly and evenly.

In order to employ the apparatus and method of the present invention, a user activates the hair curling device and heats the clipping means installed on the heating elements. To style hair, a user then compiles assemblages of curls. An assemblage of curls may comprise circular or FIG. 8 patterns by winding groups of strands of hair around one or more fingers of the user. For simple curls, the fingers of a user are removed while preserving the integrity of the assemblage of curls. Thereafter, a heated clipping means is placed over the assemblage of hair in a manner that the assemblage is contained in the space between the heat retaining means.

After the heated hair clamp remains in place for a predetermined amount of time, it is removed from the hair assemblage, which will retain a curled shape for a period of time. An alternative method creates figure eight curls. A user holds a set of hair strands between the thumb and forefinger. The strands are wrapped a half turn around the forefinger, and pulled toward the middle finger. Then the strands are wrapped around the middle finger and pulled back toward the forefinger to cross. The strands are then wrapped around the forefinger and back to the middle finger so that they cross again and the process is repeated until the entire length of the hair strand comprises a figure eight assemblage. The assemblage can then be inserted into a heated clipping means.

FIGURES

DESCRIPTION

Figure 1:
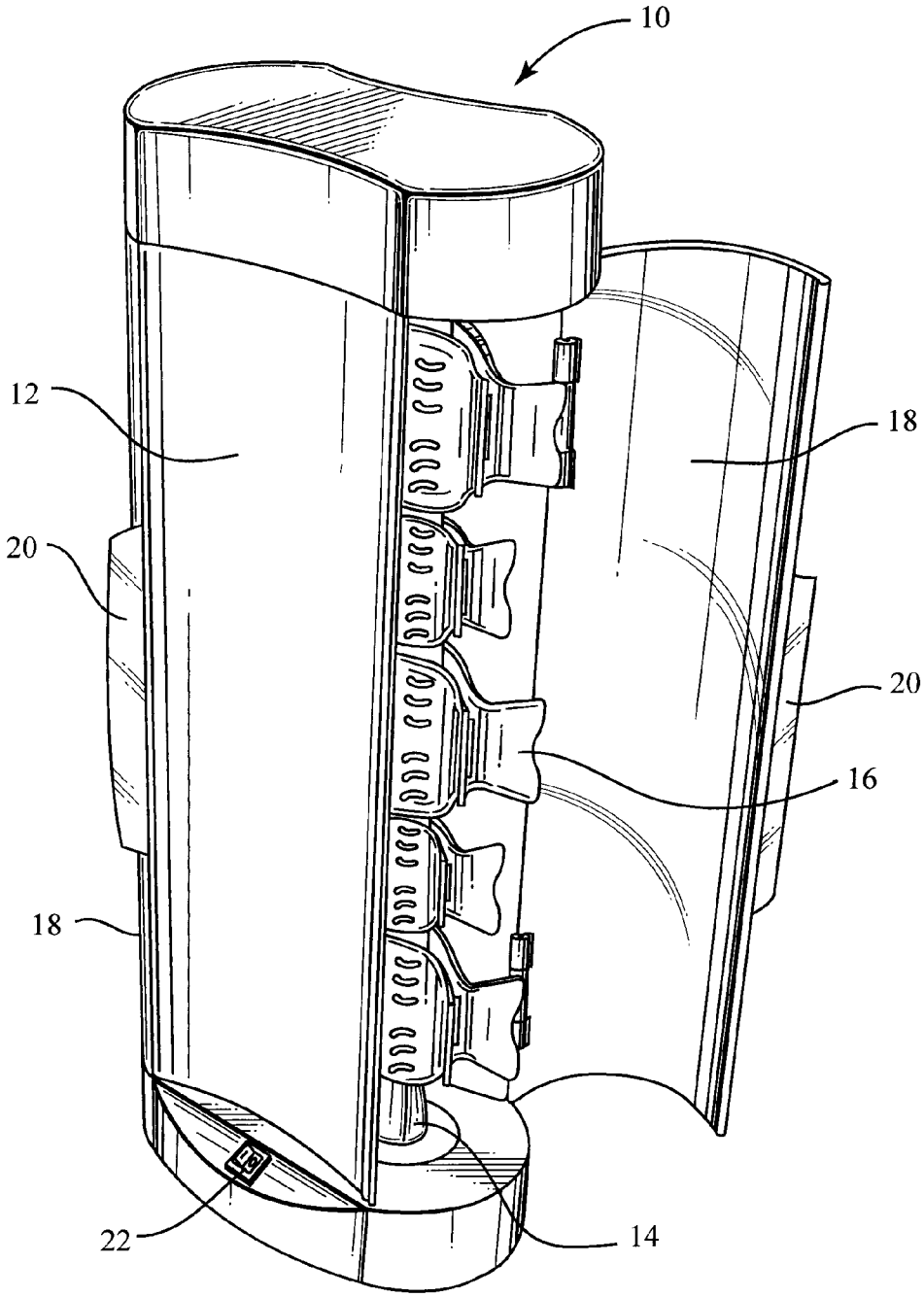
FIG. 1 is a perspective view of the device of the present invention with one door open revealing a plurality of heated clipping means.

Referring to FIG. 1, an improved hair curling device is shown and described. The hair curling device 10 comprises a housing 12 for containing and enclosing heating elements 14 and a series of heat retaining clips 16. The heating elements 14 and heat retaining clips 16 are enclosed in the housing 12 by means of access panels or doors 18. The doors 18 may be opened to allow access to the heated clips 16, and otherwise kept closed to retain heat in the housing 12. A handle means 20 is used to open the doors 18.

In a preferred embodiment, the heating elements 14 within the housing 12 are powered electrically, wherein the housing further comprises an on/off switch 22 on its exterior surface. In another preferred embodiment, the housing 12 accommodates clips of varying sizes for achieving a variety of hair styles. Although in the illustrated embodiment, the housing 12 contains two heating elements, in additional preferred embodiments, single or multiple heating elements are contemplated.

Figure 2:
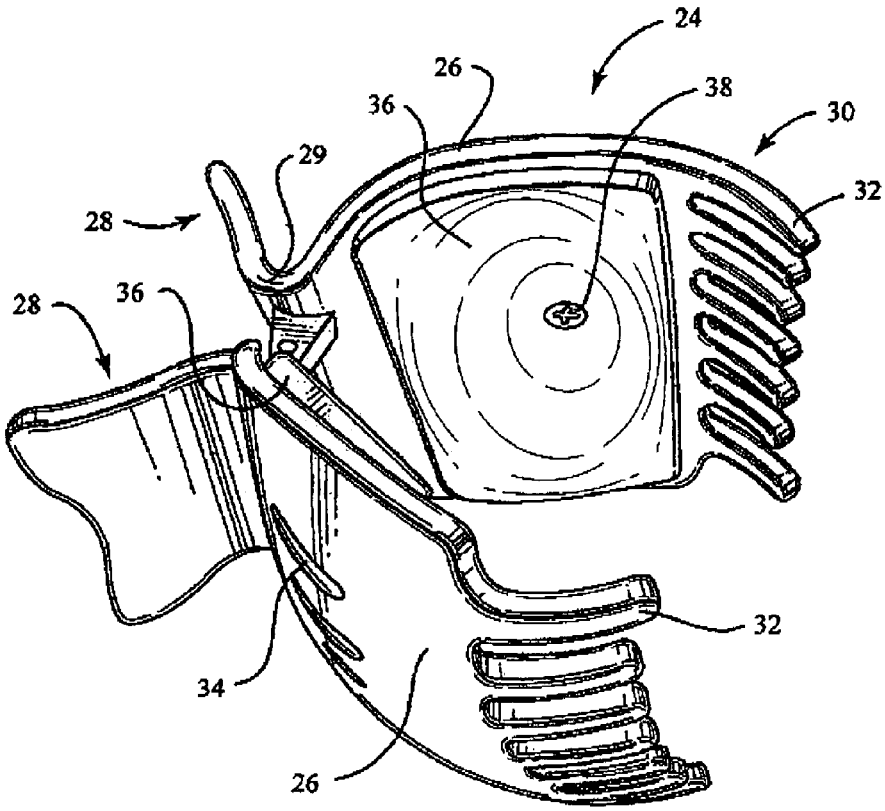
FIG. 2 is a perspective view of the clipping means of the device.

Referring to FIG. 2, the clipping means 24, comprises a pair of hinged opposing jaws 26 biased to a closed position. The jaws 26 present facing double concave inside surfaces to each other in a manner that creates a confined space between the jaws when the clipping means 24 is in a closed position, thereby forming a bowl shape therebetween. The jaws 26 comprise a proximal end 28 with a bend 29 for opening the clipping means 24 and a distal end 30 comprising a series of teeth 32 forming two interlocking combs. In one preferred embodiment, a series of vents 34 is disposed in the jaws 26 to allow excess heat to escape.

Still referring to FIG. 2, the clipping means 24 further comprises a heat retaining means 36 attached to the inside surfaces of the jaws 26. The heat retaining means 36 is adjacent to, and comprises the same concave surface characteristic as the inside surface of the jaws 26. In one preferred embodiment, the heat retaining means comprises ceramic material. In another preferred embodiment, the heat retaining means 36 is attached to the jaws 26 with a screw means 38.

Figure 3:
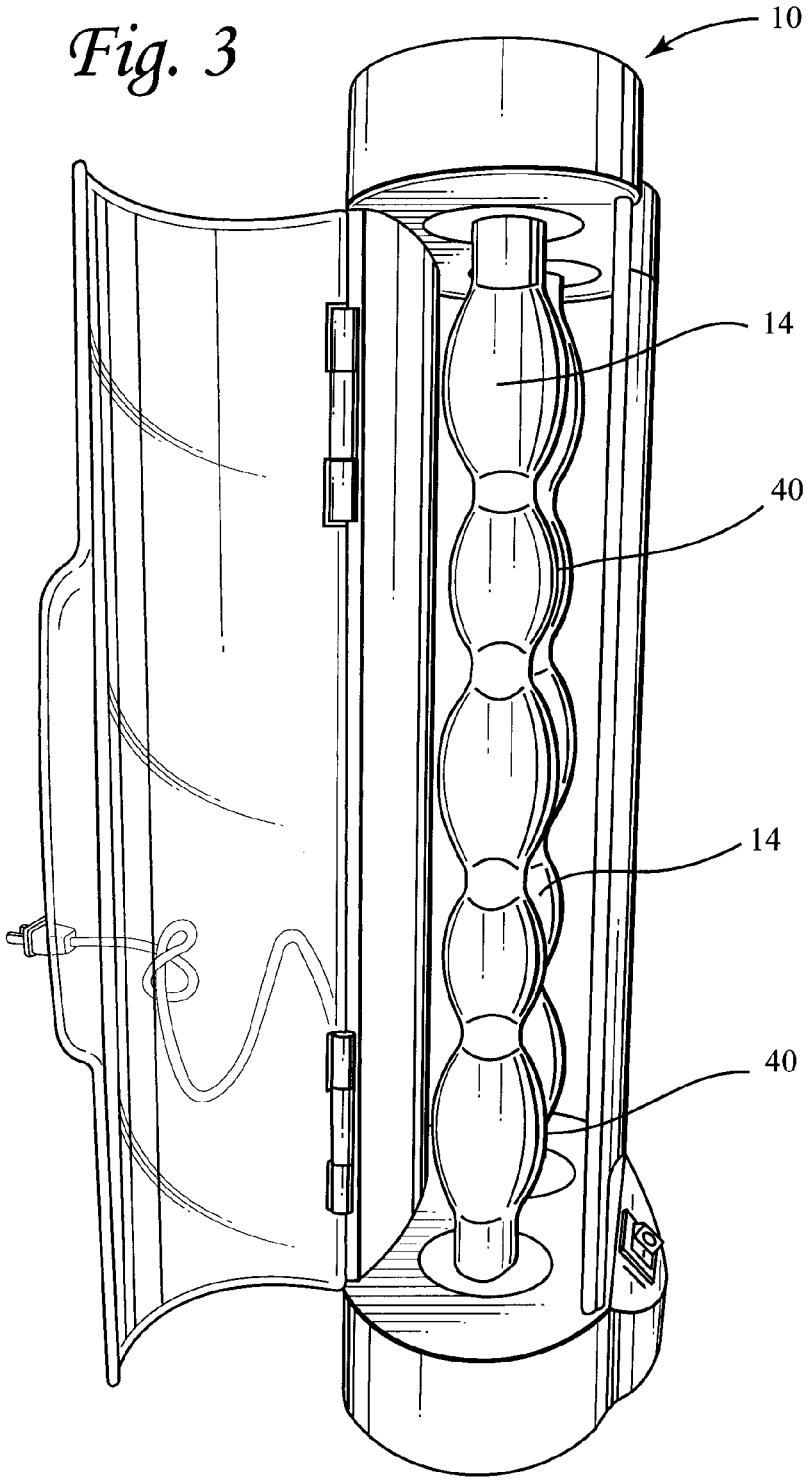
FIG. 3 is a perspective view of the device without clipping means attached.

Referring to FIG. 3, the device 10 is shown without the clipping means attached. The heating elements 14 of the device 10 comprise elongated members with a series of convex surface characteristics 40 disposed along their length. The convex surface characteristics 40 are complimentary to the concave inner surfaces of the jaws and heat retaining means so that when a clipping means 24 is disposed on a heating element 14, the heat retaining means 24 is in complete contact with the convex surface 40, thereby heating the heat retaining means 24 quickly and evenly. In further preferred embodiments, the heating elements 14 may be thermostatically controlled for achieving variable temperatures.

Figure 4:
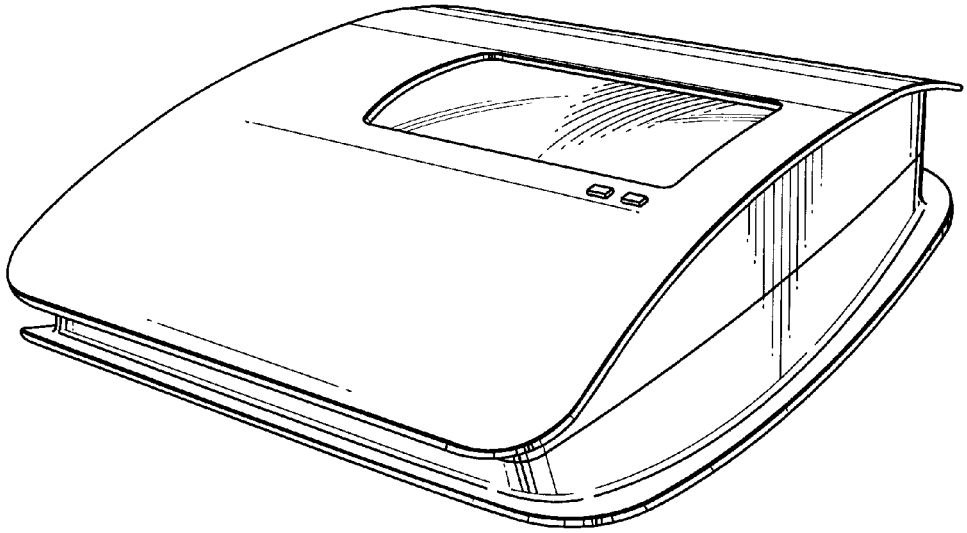
FIG. 4 is a perspective view of an alternative embodiment with a lower profile and horizontal heating elements.
Figure 5:
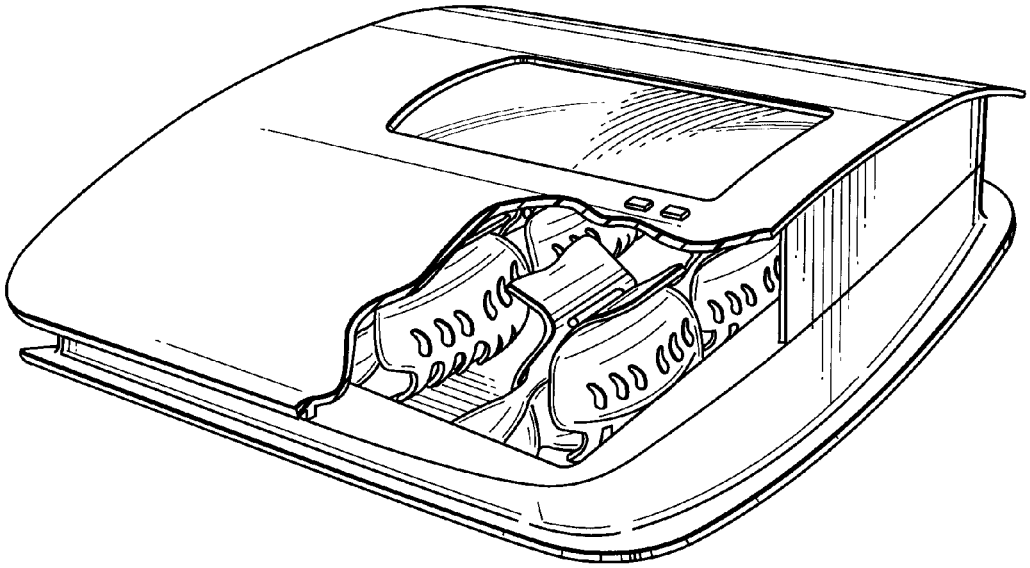
FIG. 5 is a perspective view of an alternative embodiment with the lid open.

In one preferred embodiment, the heating elements 14 are disposed in the housing 12 in a vertical configuration. Referring to FIGS. 4 and 5, an alternative embodiment of the invention is shown in which the heating elements are disposed in a horizontal configuration in a housing designed for a lower profile.

In order to employ the apparatus and method of the present invention, a user activates the hair curling device with the clipping means installed on the heating elements, thereby heating the clipping means. After a predetermined amount of time, the clipping means will arrive at the temperature governed by the device.

Strands of hair are then compiled into an assemblage of curls. An assemblage of hair may comprise circular or FIG. 8 curls by winding groups of strands of hair around one or more fingers of the user. For simple curls, the fingers of a user are removed while applying a heated clipping means to preserve the integrity of the assemblage of curls. Thereafter, the assemblage of hair is contained in the space between the heat retaining means.

After a predetermined amount of time, the clipping means is removed and the assemblage of hair will temporarily retain the curled shape. In alternate embodiments, a rod-shaped member may be used in lieu of fingers.

To make figure eight curls, a user holds a first set of hair strands at the ends of the strands between the thumb and forefinger wrapped one half turn around the forefinger, and pulled toward the middle finger. The strands are wrapped around the middle finger and back toward the forefinger, crossing. The strands are then wrapped around the forefinger and back to the middle finger so that they cross again. This process is repeated until the entire length of the hair strands comprises a figure eight assemblage. This assemblage can then be inserted into a clipping means.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An improved hair curling device comprising:

a. clipping means, comprising a pair of biasable opposing jaws, each jaw having double concave inside surfaces forming a bowl shape wherein the jaws face each other in a manner that and creates a confined space between the jaws when in a closed position for retaining the hair therein;

b. a heat retaining element attached to the inside surfaces of the jaws, adjacent to, and comprising the same double concave shape as the inside surface of the jaws; and c. a heater for the clips comprising a housing and a plurality of locations for heating and retaining the clips at a desired temperature, wherein each location comprises a double convex surface complimentary to the double concave shape of the inside surfaces of the jaws.

2. The device of claim 1, wherein the clipping means is disposed at the heater with the heat retaining element is in complete contact with the heater.

3. The device of claim 1, wherein the heat retaining element comprises ceramic.

4. The device of claim 1, comprising a venting means is disposed on the jaws to allow heat to dissipate from the heat retaining element.

5. The device of claim 1, wherein each jaw of the clipping means comprises a proximal end with an opening means and a distal end with a retaining means, wherein the jaws of the clipping means are biased to the closed position.

6. The device of claim 5, wherein the proximal end further comprises a handle means and the distal end comprises comb fingers that interlock when the clipping means is in the closed position.

7. The device of claim 6, wherein the heat retaining element is disposed between the handle means and the comb fingers.

8. The device of claim 1, wherein the heater is electrically powered and comprises a closable housing.

9. The device of claim 8, wherein the heater holds the clipping means in a vertical configuration.

10. The device of claim 8, wherein the heater holds the clipping means in a horizontal position.

11. The device of claim 1, wherein the heater can be set to variable temperatures.

12. A clip for hair curling comprising:

a. a pair of opposing jaws having an open and a closed position, each jaw having a double concave inside surface forming a bowl shape wherein the jaws face each other in a manner that and creates a confined space between the jaws when in the closed position for retaining the hair therein; and b. a heat retaining element disposed on the inside surface of each jaw.

13. The clip of claim 12, wherein the heat retaining element comprises ceramic.

14. The clip of claim 12, wherein each jaw comprises a proximal end with an opening means and a distal end with a retaining means.

15. The clip of claim 14, wherein the proximal end further comprises a handle means and the distal end comprises comb fingers that interlock when the clip is in the closed position.

16. The clip of claim 12, wherein the opposing jaws are biased to the closed position.

17. The clip of claim 12, further comprising a spring for biasing the opposing jaws to the closed position.

18. A hair curling device comprising:

a. a plurality of clipping means, each clipping means comprising a pair of biasable opposing jaws comprising a proximal end and a distal end, each jaw having double concave inside surfaces forming a bowl shape wherein the jaws face each other in a manner that creates a confined space between the jaws when in a closed position for retaining the hair therein;

b. a heat retaining element attached to the inside surfaces of the jaws, adjacent to, and comprising the same double concave shape as the inside surface of the jaws, wherein the heat retaining element comprises ceramic; and c. an electrically powered heater for the clips comprising a housing and a plurality of locations for heating and retaining the clips at a desired temperature, wherein each location comprises a double convex surface complimentary to the double concave shape of the inside surfaces of the jaws.

* * * * *